US007349641B2

(12) United States Patent
Ogashima

(10) Patent No.: US 7,349,641 B2
(45) Date of Patent: Mar. 25, 2008

(54) FIXING UNIT AND IMAGE FORMING APPARATUS

(75) Inventor: Sakae Ogashima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 58 days.

(21) Appl. No.: 10/974,794

(22) Filed: Oct. 28, 2004

(65) Prior Publication Data

US 2005/0111863 A1 May 26, 2005

(30) Foreign Application Priority Data

Nov. 21, 2003 (JP) ..... 2003-391949

(51) Int. Cl.
*G03G 15/20* (2006.01)

(52) U.S. Cl. ..... 399/69

(58) Field of Classification Search ..... 399/69, 399/94, 126, 320, 328
See application file for complete search history.

(56) References Cited

U.S. PATENT DOCUMENTS

| | | | | |
|---|---|---|---|---|
| 5,281,793 | A * | 1/1994 | Gavin et al. | 399/69 X |
| 5,765,075 | A * | 6/1998 | Yamamoto | 399/69 |
| 6,671,471 | B2 * | 12/2003 | Nakamura et al. | 399/69 |
| 2003/0227533 | A1 * | 12/2003 | Yokoi | 347/156 |
| 2004/0086295 | A1 * | 5/2004 | Peng et al. | 399/69 |

FOREIGN PATENT DOCUMENTS

| | | |
|---|---|---|
| JP | 7-181833 | 7/1995 |
| JP | 2001-242741 | 9/2001 |

* cited by examiner

*Primary Examiner*—David M. Gray
*Assistant Examiner*—Erika J. Villaluna
(74) *Attorney, Agent, or Firm*—Kubotera & Associates, LLC

(57) ABSTRACT

A fixing unit for an image forming apparatus includes a heating element 102, a temperature sensor 119 to detect the temperature of the hating element, and an arm to hold the temperature sensor 119, and positioning means 108 and 110 to adjust the position of the arm 105 with respect to the heating element.

16 Claims, 12 Drawing Sheets

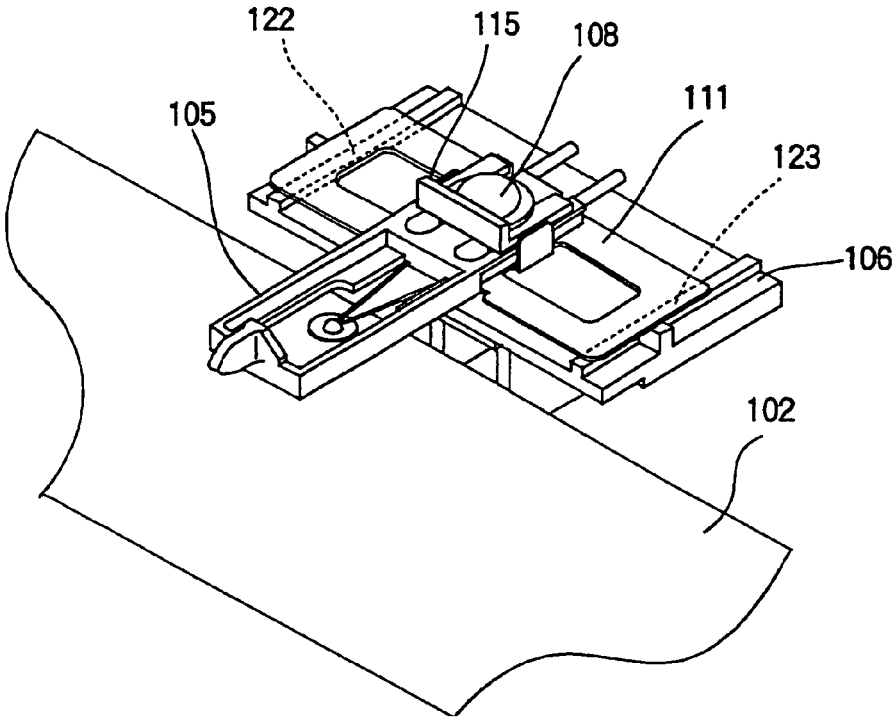
FIG. 7
FIG. 8 (a)
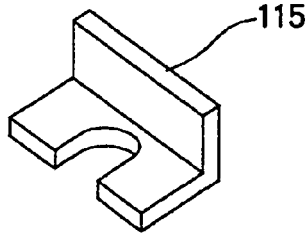
FIG. 8 (b)
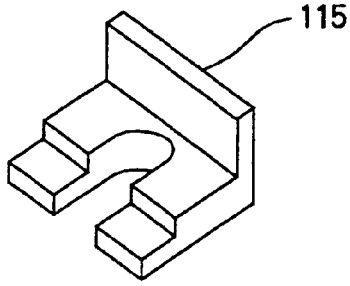

FIXING UNIT AND IMAGE FORMING APPARATUS

BACKGROUND OF THE INVENTION

1. Field of the Invention

The present invention relates to a fixing unit for an image forming apparatus.

2. Description of the Related Art

An image forming apparatus such as an electronic photo printer usually forms an electrostatic latent image on a photosensitive drum using a laser beam or the like, and forms a toner image by developing the electrostatic latent image with a toner. Then, it transfers the toner image onto printing paper, fixes the toner image on the printing paper with a fixing device having a fixing roller, and then ejects the paper. Such electronic photo printer and fixing device are disclosed, for example, in Unexamined Japan Patent Application Publication 07-181833 and Unexamined Japan Patent Application Publication 2001-242741.

FIG. 15 schematically illustrates the constitution of the electronic photo printer disclosed in Unexamined Japan Patent Application Publication 07-181833. This electronic photo printer is comprised of a paper cassette 1 to store printing paper 20, a paper feeding roller 2 to feed the printing paper, a paper conveyance roller 4 to convey the printing paper 20, a photosensitive drum 5 to transfer a printing toner (not illustrated) onto the printing paper 20, a fixing device to fix the transferred toner on the printing paper 20, and a stacker 22 to store the paper 20 after printing.

This electronic photo printer further comprises a cassette sensor 25 to detect if the paper cassette 1 is inserted and in a position, and a paper feeding sensor 3*a* which is provided between the paper feeding roller 2 and the paper conveyance roller 4 to detect the presence of the printing paper 20. In addition, a charger 6 to uniformly charge the surface of the photosensitive drum 5, an LED head 7 to form an electrostatic latent image that corresponds to the shapes of characters and the like by irradiating a specified light beam onto the surface of the charged photosensitive drum 5, a developing device 8 to form a toner image by developing the electrostatic latent image through adhering toner on the electrostatic latent image, a transferring device 9 to transfer the toner image onto printing paper 20, and a cleaner 10 to remove the toner remained on the photosensitive drum 8 are provided around the photosensitive drum 5.

Furthermore, the fixing device 21 has a heater 21*a* provided inside the roller, and a thermistor 21*b* to detect temperature change of the roller. By heating and pressuring with the roller the toner image transferred on the printing paper 20, the toner image is fixed. A paper ejection sensor 3*b* to detect the presence of the printing paper 20 passing through the fixing device 21 is provided between the fixing device 21 and the stacker 22.

Moreover, the electronic photo printer has a first controlling unit 23*a* to control the operation of the mechanism of each element, an operation panel 24 to notify an operator of specified alarm and to set a menu, and a second controlling unit 23*b* to control the operation panel 24, communicate with upper device(s), edit printing data, and so on. The first controlling unit 23*a* and the second controlling unit 23*b* are connected to each other via a serial interface and a video interface.

FIG. 16 is a circuit diagram of the first controlling unit 23*a* which controls the operation of the mechanism of the above-described electronic photo printer. A microprocessor 13*c* of the first controlling unit 23*a* mainly outputs a motor 1 control signal (a), a motor 2 control signal (b), a motor 3 control signal (c) and a heater control signal (h) based on a comparator output signal (g), a paper feeding sensor signal (d), a paper ejecting sensor signal (e), and a cassette sensor signal (f).

Here, the motor 1 control signal (a) is a control signal for the motor 1, which is outputted from an output port P3.0 of a microprocessor 13*c*, and drives the photosensitive drum 5 and the roller of the fixing device 21 shown in FIG. 15 via the motor controlling circuit 14. The motor 2 control signal (b) is a control signal for a motor 2, which is outputted from an output port P3.1 of the microprocessor 13*c*, and drives the paper feeding roller 2 shown in FIG. 15 via the motor control circuit 14. The motor 3 control signal (c) is a control signal for a motor 3, which is outputted from an output port P3.2 of the microprocessor 13*c*, and drives the conveyance roller 4 shown in FIG. 15 via the motor control circuit 14. The motor control circuit 14 is connected to an oscillator 15. The rotational speeds of the motors 1-3 are determined by the values of frequency oscillated by the oscillator 15.

The paper feeding sensor signal (d) is an output signal from the paper feeding sensor 3*a* shown in FIG. 15, and is connected to an input port P2.1 of the microprocessor 13*c*. The paper ejecting sensor signal (e) is an output signal from the paper ejecting sensor 3*b* shown in FIG. 15, and is connected to an input port P2.2 of the microprocessor 13*c*. The cassette sensor signal (f) is an output signal from the cassette sensor 25, and connected to an input port P2.3.

A comparator output signal (g) is a signal outputted from a comparator 12, and is connected to an input port P2.0 of the microprocessor 13*c*. The input terminal a of the comparator 12, to which the reference voltage is applied, is connected to a pull-up resistance R3, a pull-down resistance R4, and a hysteresis resistance R2. The input terminal b of the comparator 12 is connected to the pull-up resistance R5 and the terminal a of the thermistor 21*b*, while the terminal b of the thermistor 21*b* is connected to ground. The output terminal c of the comparator 12 is connected to the pull-up resistance R1, the hysteresis resistance R2, and the input port P2.0 of the microprocessor 13*c*.

In addition, the heater control signal (h) is outputted from an output port P1.0 of the microprocessor 13*c*, and is connected to a power control circuit (not illustrated) of the heater 21*a* of the fixing device 21 shown in FIG. 15 so as to perform ON/OFF control of the heater 21*a*.

The thermistor 21*b* shown in FIGS. 15 and 16 has the characteristics of having smaller resistance as the temperature becomes higher, and larger resistance as the temperature becomes lower. For this reason, the voltage Vb applied to the input terminal b of the comparator 12 becomes lower as the temperature becomes higher, and the voltage Vb becomes higher as the temperature becomes lower.

FIG. 17 is a time chart in the temperature control of the heater 21*a* using the above-described characteristics. Here, Vb shows the waveform of the voltage applied to the input terminal b of the comparator 12, Va-High is the reference voltage applied as a high slice level to the input terminal a of the comparator 12, and Va-Low is the reference voltage applied as a low slice level to the input terminal a of the comparator 12. TL is the length of time from when Vb reaches Va-High to when Vb reaches Va-Low, and TH is the length of time from when Vb reaches Va-High to when Vb reaches Va-Low.

Once the voltage Vb applied to the input terminal b of the comparator 12 exceeds the high slice level voltage applied to the input terminal a of the comparator 12, the comparator output signal (g) becomes low level. The microprocessor 13*c* shown in FIG. 16 detects the comparator output signal (g) which is low level at the input port P2.0, and turns "ON" the heater 21*a*, setting the output port P1.0 as high level.

When the heater 21*a* is turned "ON", the temperature of the roller of the fixing device 21 becomes higher, the resistance of the thermistor 21*b* becomes smaller, and the voltage Vb applied to the input terminal b of the comparator 12 becomes lower. Once Vb becomes lower than the low slice level Va-Low applied to the input terminal a of the comparator 12, the comparator output signal (g) becomes High level. The microprocessor 13*c* detects the comparator output signal (g) which becomes high level at the input port P2.0, and turns "OFF" the heater 21*a*, setting the output port P1.0 as low level. By repeating the above-described control of the heater 21*a* from when the power of the electronic photo printer is ON till the power is OFF, the temperature of the roller of the fixing device is maintained at a substantially constant temperature.

Referring now to a time chart of FIG. 18, the method of controlling the above-described electronic photo printer is described. Here, the reference numerals not indicated in FIG. 18 shall be referred to those in FIGS. 15 and 16. Once the second controlling unit receives printing data from the upper device (not illustrated), it produces an image data for printing, and then writes the data in a memory (not illustrated). Then, once editing one page of the image data is completed, a printing instruction is sent to the controlling unit 23*a*.

Once the first controlling unit 23*a* receives a start printing instruction from the second controlling unit 23, it rotates the photosensitive drum 5 and the roller of the fixing device 21, setting the motor 1 control signal (a) as high level. At the same time, by driving the charger 6, the surface of the photosensitive drum 5 is uniformly charged. After that, the motor 2 control signal is set as high level, and a sheet of the printing paper 20 in the paper cassette 1 is fed toward the conveyance roller 4. Once the paper feeding signal (d) becomes high level (i.e. if the paper 20 is passing the paper feeding sensor 3*a*), the rotation of the paper feeding roller 2 stops, setting the motor 2 control signal (b) as low level after a specified length of time (until the front edge of the paper contacts the conveyance roller 4).

Once the rotation of the paper feeding roller 2 is stopped, the paper 20 is fed toward the fixing device 21 by rotating the roller 4, setting the motor 3 control signal (c) as high level. At this time, the second controlling unit 23*b* sends the image data for printing to the LED head 7 via the first controlling unit 23*a*, and forms an electrostatic latent image on the surface of the photosensitive drum 5. Then, the toner image is formed from the electrostatic latent image by the developing device 8, and then transferred onto the paper 20. The paper having the transferred toner image is conveyed to the fixing device 21, and the toner image is fixed on the paper 20 by heating and pressuring. Thereafter, the paper that passed the fixing device 21 reaches the paper ejecting sensor 3*b*, and the paper ejecting sensor signal (e) becomes high level. Then, if the paper is further conveyed, and the paper ejecting sensor signal (e) becomes low level, the paper 20 after printing is stored in the stacker, and the printing is completed.

After completing the printing, the first controlling unit 23*a* notifies the completion of the printing to the second controlling unit 23*b*. Once the second controlling unit 23*b* receives the notification of the completion of the printing, it clears the memory, in which a page of image is written. If there is no printing instruction from the second controlling unit 23*b* within a specified period of time after the paper 20 passes the paper ejecting sensor 3*b*, the first controlling unit 23*a* stops the rotation of the photosensitive drum 5 and the fixing device 21. On the other hand, if there is a printing instruction from the second controlling unit 23*b* within the specified period of time, the paper feeding roller 2 is rotated, setting the motor 2 control signal (b) as high level, and printing on the next sheet of the paper 20 is performed. By repeating the above-described operations, a series of printing process is performed.

As described above, in the image forming device such as the electronic photo printer, the temperature of the roller of the fixing device can be detected without contacting the roller surface. Therefore, the thermistor is attached to the frame being specified distance away from the surface of the fixing roller, and the timing for turning ON/OFF the heater in the fixing roller is controlled based on the temperature detected by the thermistor. By heat of the heating element and pressure applied by the fixing roller, the toner is fixed on the printing paper, and then the printing is completed.

However, since the distance between the fixing roller and the thermistor varies depending on the dimensional precision or precision of attachments related to a frame or other components, the temperature detected by the thermistor of conventional fixing device varies, which affects the temperature control of the roller surface of the fixing device.

SUMMARY OF THE INVENTION

Accordingly, it is an object of the invention to improve the precision of the fixing temperature. It is another object of this invention to stabilize the printing quality by controlling the dispersion of the temperature detected by the thermistor due to the dispersion of the distance between the fixing roller and the thermistor in the fixing device used in the image forming device such as electronic photo printer.

According to the invention there is provided a fixing device for an image forming device which comprises an arm to hold a temperature sensor, and a positioning means to adjust the position of the arm with respect to the heating element.

According to this invention, the dispersion of the temperature detected by the thermistor due to the dispersion of the distance between the fixing roller and the thermistor in the fixing device used in the image forming device such as electronic photo printer can be controlled, and therefore, the precision of the fixing temperature can be improved, and the printing quality can be stabilized.

BRIEF DESCRIPTION OF THE DRAWINGS

FIG. 7 is a perspective view of the sensor arm of the fixing device in the third embodiment of this invention.

FIGS. 8(*a*) and 8(*b*) are a perspective view of the position adjusting spacer to use for the fixing device of the third embodiment, respectively.

DESCRIPTION OF THE PREFERRED EMBODIMENTS

Figure 1:
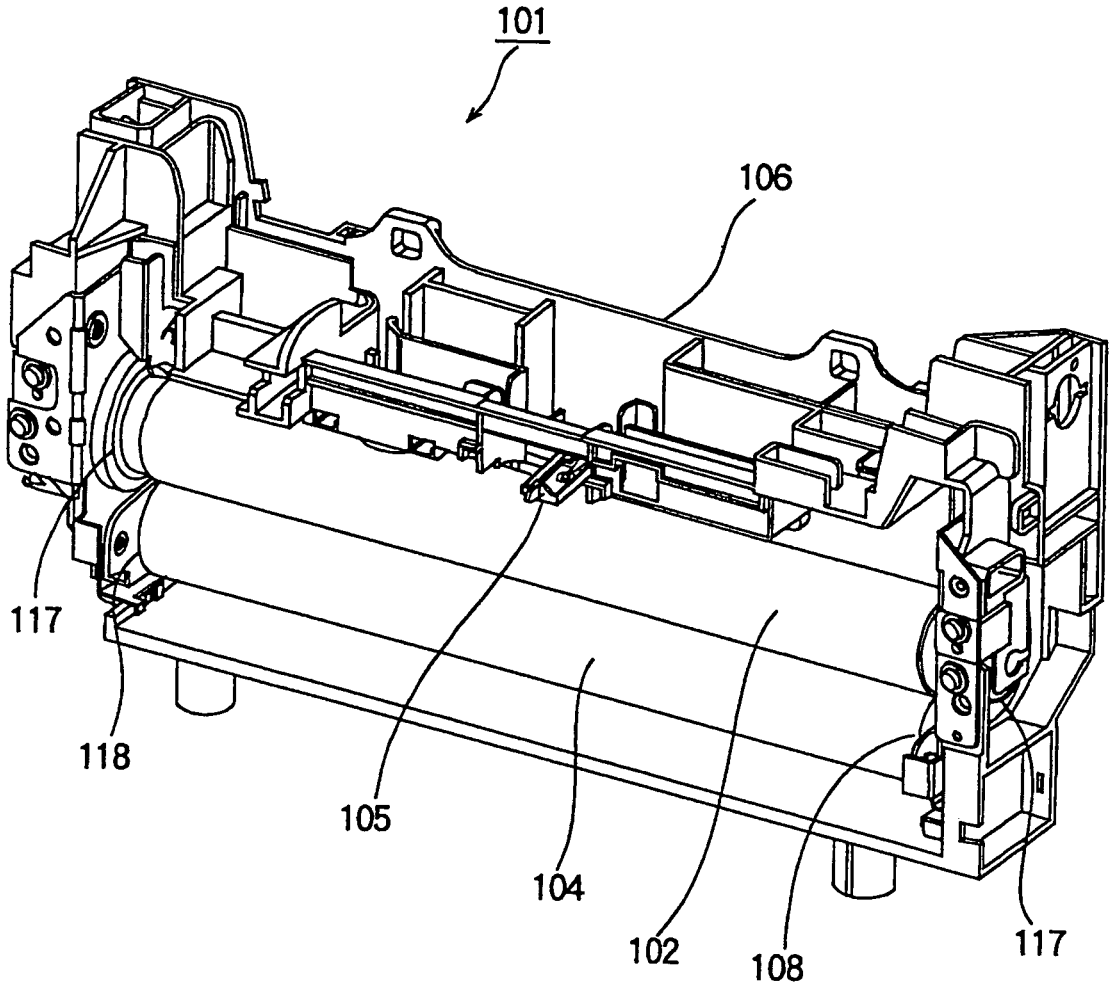
FIG. 1 is a perspective view of the fixing device in the first embodiment of this invention.

FIG. 1 shows the fixing device 101 of the first embodiment. A heat roller bearing 117 is attached to a frame 106 of the fixing device 101, and a heat roller 102 is supported by the heat roller bearing 117 so as to be freely rotatable. A heating element (e.g. halogen lamp) 103 is provided inside the heat roller 102. A pressure roller 104 supported by the pressure roller bearing 118 so as to be freely rotatable is provided under the heat roller 102. The pressure roller bearing 118 is attached to the frame 106 so as to be movable and biased toward the heat roller 102 by a coil spring (not illustrated).

Figure 2:
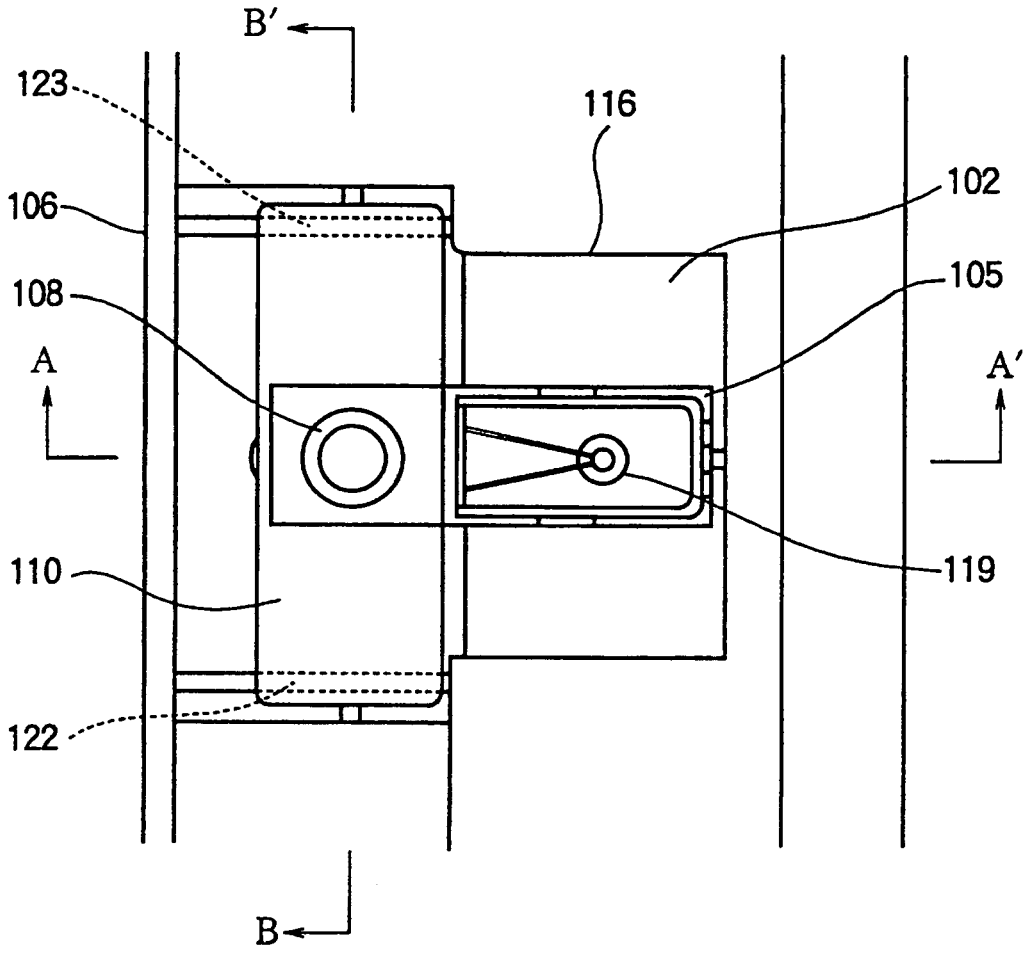
FIG. 2 is an enlarged view of the frame opening and the sensor arm of the fixing device of FIG. 1.
Figure 3:
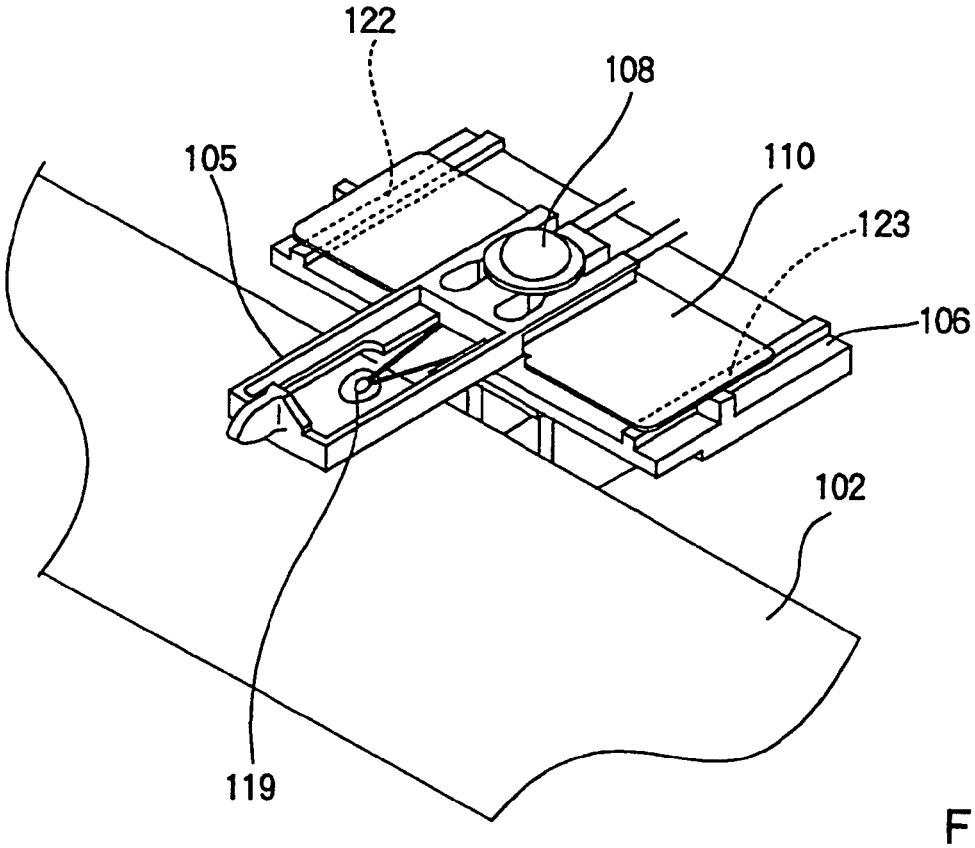
FIG. 3 is a perspective view of the sensor arm of the fixing device of FIG. 1.

FIG. 2 shows the sensor arm 105 of the fixing device 101. As shown in this figure, the frame 106 has a frame opening 116 for adjusting the position of the sensor arm 105. FIG. 3 shows the sensor arm 105 of the fixing device 101. As shown in FIGS. 2 and 3, the frame 106 has a first contact section 122 and a second contact section 123, which contact with respective edges of a flat spring 110. The sensor arm 105 is attached to the frame with a screw 108 via the flat spring 110. A temperature detector 119 such as the one comprised of a thermistor is provided to the sensor arm at its base section, and the heat roller is disposed right under the temperature detector 119.

Figure 4:
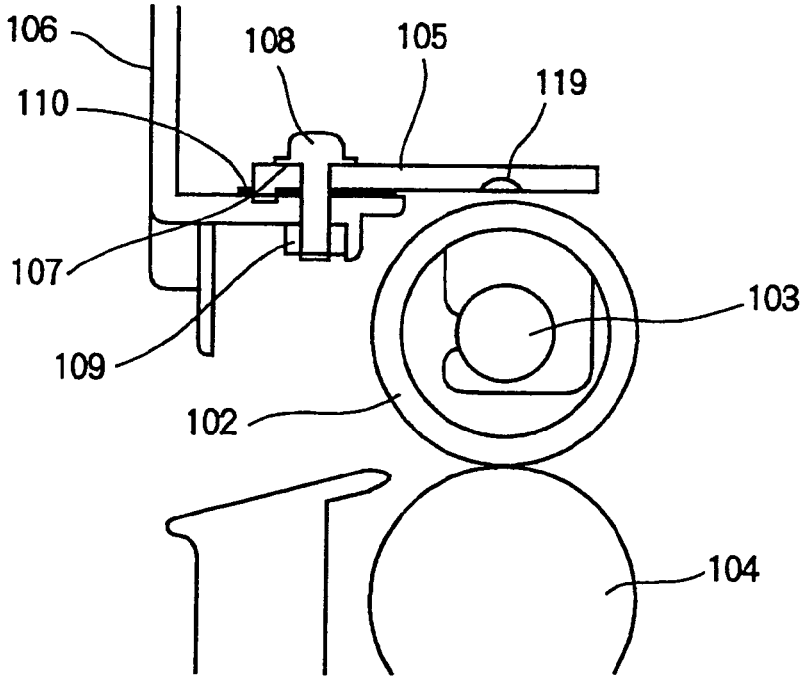
FIG. 4 is a cross-sectional view taken along a line A-A' of FIG. 2.

As shown in FIG. 4, the sensor arm 105 and the flat or leaf spring 110 are attached to the frame 106 with the screw and a nut 109 fitted to the screw. The sensor arm 105 is interposed between the flat spring 110 and a positioning section 107 defined by the collar of the screw head of the screw 108, and extends generally parallel to the tangential line of the highest point of the circumference of the heat roller 102.

Figure 5:
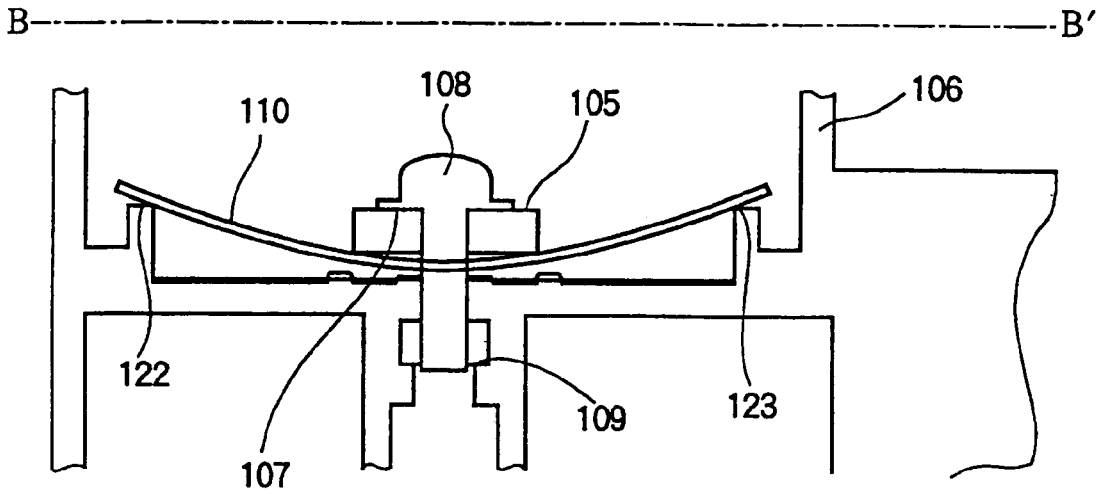
FIG. 5 is a cross-sectional view taken along a line B-B' of FIG. 2.

In FIG. 5, since the flat spring 110 is supported by the first contact section 122 and the second contact section 123 of the frame 106 and its generally center part is flexed being pushed by the sensor arm 105, the sensor arm 105 is energized toward the positioning section 107 by the elastic force of the flat spring 110. Therefore, by rotating the screw 108, the positioning section moves upward/downward, and therefore the sensor arm 105 moves upward/downward as the positioning section 107 moves, being energized by the flat spring 110.

With the above-described constitution, the positioning section 107 of the screw 108 can be moved toward/away from the heat roller 102 supported to the frame 106 by rotating the screw 108. If the positioning section 107 moves away from the heat roller 106, the amount of flexion of the flat screw 110 is reduced, so that the sensor arm 105 biased toward the screw head moves with the positioning section 107 away from the heat roller 102. If the positioning section 107 is moved toward the heat roller 102, the amount of flexion of the flat spring 110 increases, so that the sensor arm 105 biased toward the screw head moves with the positioning section 107 toward the heat roller 102. Therefore, the position of the sensor arm 105 with respect to the heat roller 102 can be adjusted by rotating the screw 108.

Since the screw 108 is energized by the flat spring 110, it is difficult to loosen. In addition, since the sensor arm 105 is elastically supported by the flat spring 110, the sensor arm 105 will not be damaged by undesired force from paper jam between the heat roller 102 and the sensor arm 105. In this case, if the jammed paper is removed, the sensor arm will be back to the original position by the energizing or biasing force of the flat spring 110.

As described above, according to the first embodiment, since the sensor arm 105 is attached to the frame via the flat spring 110 and is movable upward/downward by rotating the spring 108, the distance between the heat roller 102 and the sensor arm 105 can be adjusted, and the surface temperature of the heat roller can be precisely measured. Furthermore, since the sensor arm 105 is attached so as to extend generally along the tangential line of the highest point of the circumference of the heat roller 102, the clearance can be precisely measured using a clearance gauge or the like.

Figure 6:
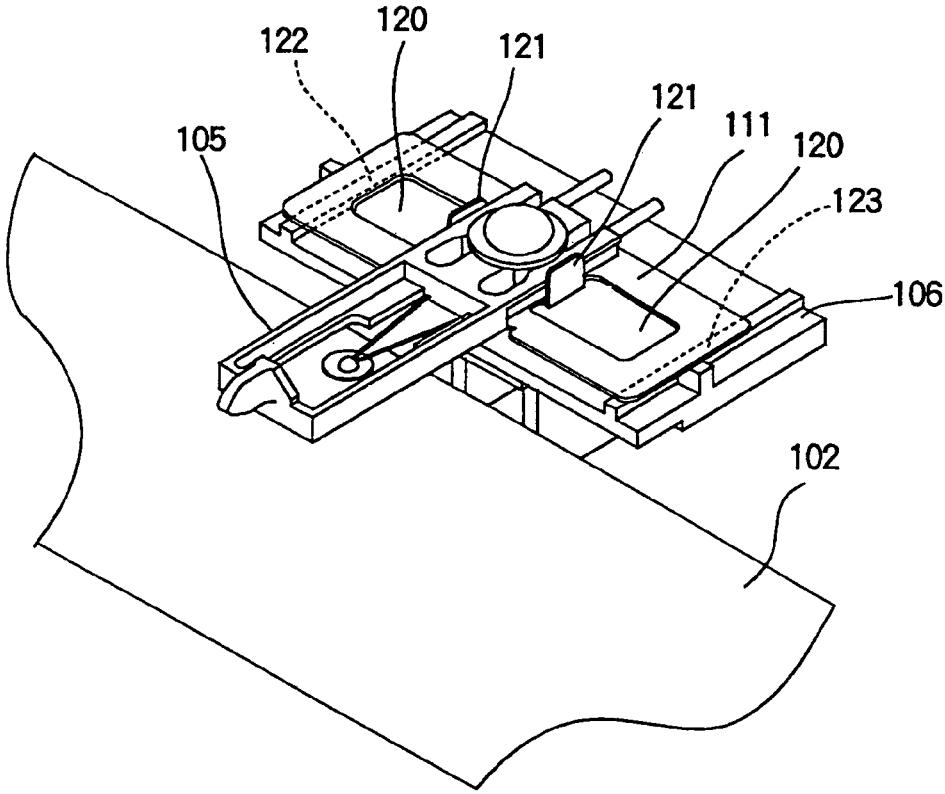
FIG. 6 is a perspective view of the sensor arm of the fixing device in the second embodiment.

FIG. 6 shows the sensor arm of the fixing device of the second embodiment of this invention. In this embodiment, another flat or leaf spring 111 is used in place of the flat spring 110. This flat spring 111 has openings 120 provided between the sensor arm 105 and the first contact section 122 of the frame 106 and between the sensor arm 105 and the second contact section 123 of the frame 106. In addition, the flat spring 111 has a restricting member 121 to restrict the sensor arm from moving in the lateral direction (the direction perpendicular to the longitudinal directions of the screw 108 and the sensor arm 105, i.e. the direction parallel to the axial direction of the heat roller 102). The fixing device of this embodiment is similar to that of the first embodiment, but differs only in having the flat spring 111, therefore the explanation is omitted.

Similarly to the first embodiment, in the second embodiment, the position of the sensor arm 105 with respect to the heat roller 102 can be adjusted by rotating the screw 108 through the opening 116 of the frame 106.

In this embodiment, since the movement of the sensor arm 105 in the lateral direction is restricted by the restricting member 121, when the position of the sensor arm 105 is adjusted by rotating the screw 108, the sensor arm 105 will not rotate about the screw 108, but moves only upward/downward. Therefore, the position of the temperature detector 119 will not be off in the lateral direction.

Furthermore, since the portions of the flat spring 111, which are between the respective edges that contact with the first and the second contact sections and the generally central part of the flat spring 111, are made narrow, these portions are easily flexed, so that strong force does not have to be applied to adjust the screw 108. On the other hand, the surface of the portion of the flat spring 110 to attach the sensor arm 105 is difficult to be flexed and generally flat, so that the sensor arm 105 can be stably positioned. Accordingly, since the rotational movement of the screw 108 does not cause rotation of the sensor arm around the screw, the position of the sensor arm 105 will not be off in lateral direction.

As described above, in the flat spring 111 of this embodiment, the section that contacts the first contact section 122 and the section that contacts the second contact section 123 are respectively connected to the generally central portion of the flat spring 111 to attach the sensor arm by easily flexible narrow sections. Therefore, there is an advantage that strong force is not required to adjust the screw 108. In addition, since the surface of the flat spring 111 for attaching to the sensor arm 105 is difficult to flex and made generally flat, there is another advantage that the sensor arm 105 can be stably positioned.

FIG. 7 shows the sensor arm 105 of the fixing device of the third embodiment. This embodiment is featured by having a position adjusting spacer 115, which is configured as shown in FIG. 8(*a*). While this spacer 115 is interposed between the positioning section 107 of the screw 108 and the sensor arm 105, the position of the sensor arm 105 is adjusted by rotating the screw 108 such that the sensor arm 105 contacts with the surface of the heat roller 105. Thereafter, the position adjusting spacer 115 is removed, so that the sensor arm 105 will move upward for the thickness of the position adjusting spacer 115. Accordingly, the sensor arm 105 is moved away from the surface of the heat roller 102 for the distance equal to the thickness of the position adjusting spacer. Therefore, according to this embodiment, the position of the sensor arm can be easily adjusted without the clearance gauge.

Conventionally, to adjust the clearance between the sensor arm and the heat roller, the clearance gauge was inserted between the sensor arm and the heat roller, the position of the sensor arm is adjusted such that the sensor arm contacts with the inserted clearance gauge, and the clearance gauge was removed. In this conventional technique, however, the thermistor or the surface of the heat roller can be damaged by the clearance gauge through scraping against the thermistor or the heat roller when the clearance gauge is pulled out. As described above, according to this embodiment, since the position of the sensor arm can be adjusted without using the clearance gauge, there is no concern of damaging the thermistor or the heat roller surface.

As shown in FIG. 8(*b*), the position adjusting spacer 115 can have a stepwise structure consist of a first step section, which is interposed between the position adjusting section 107 and the sensor arm 105 when the image forming device is used as usual, and a second step section which is interposed between the position adjusting section 107 and the sensor arm 105 when the position of the sensor arm 105 is adjusted. In this case, by moving the position adjusting spacer 115 forward/backward at the time of adjusting the position of the sensor arm 105, the position of the sensor arm 105 can be adjusted such that the sensor arm 105 is away from the surface of the heat roller 102 for the distance equal to the difference of the thickness between the first and the second step sections. Also in this case, the position of the sensor arm can be easily adjusted without using a clearance gauge. In addition, since this position adjusting spacer having stepwise structure can be kept attached even when the image forming device is used as usual, it does not have to be attached or removed whenever the position of the sensor arm has to be adjusted.

Figure 9:
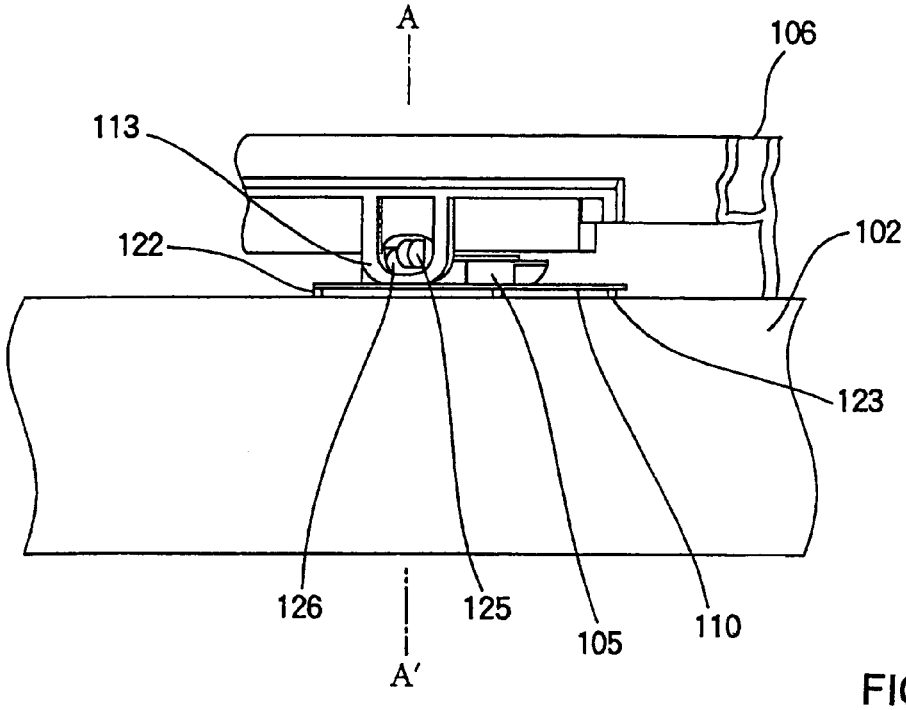
FIG. 9 is a front view of the sensor arm of the fixing device of the fourth embodiment, which is viewed from the protrusion provided at the end of the sensor arm.
Figure 10:
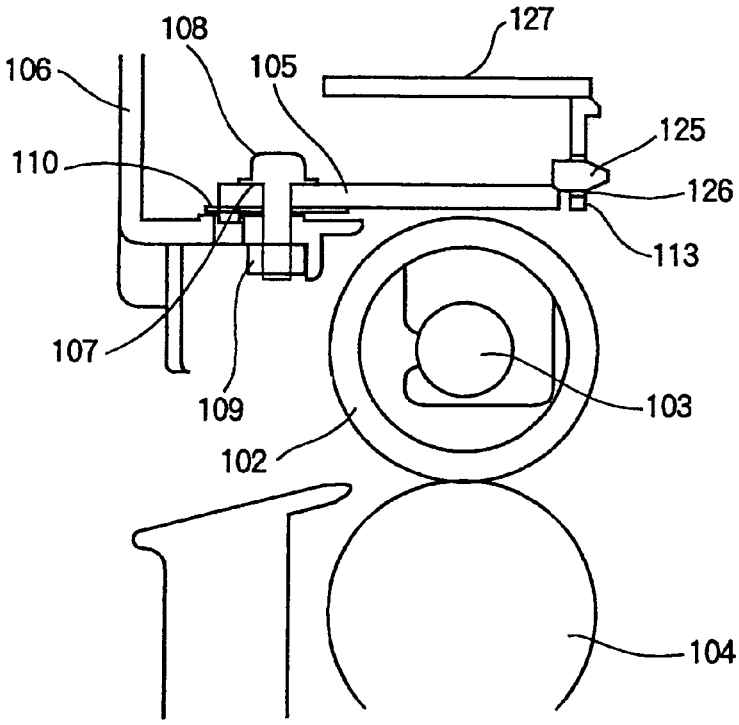
FIG. 10 is a partial cross-sectional view of the fixing device of the fourth embodiment.

FIG. 9 shows the sensor arm of the fixing device of the fourth embodiment, which is viewed from the temperature detector side, and FIG. 10 is a cross-sectional view taken along a line A-A' of FIG. 9. As shown in those figures, this embodiment is different from the first embodiment because a protrusion 125, which extends generally parallel to the tangential line of the highest point of the circumference of the heat roller 102 is provided at the end of the sensor arm 105, and a restricting section 127 having a hole 126 to put the protrusion therein is provided at the frame 106.

In this embodiment, even if the screw 108 is excessively tighten, since the protrusion 125 works as a stopper by contacting the lower part of the wall surface of the hole 126 of the restricting part 127, the sensor arm 105 will not touch the heat roller 102. In this case, since the sensor arm 105 pivots upward/downward having the contact point between the protrusion 125 and the wall surface of the hole 126 as a fulcrum as the flat spring 111 is flexed, the sensor arm 105 will not be damaged. According to this embodiment, since the protrusion 125 of the sensor arm 105 and the hole 126 of the restricting part 127 work as the stopper when the screw is excessively tighten and the interference of the sensor arm 105 with the heat roller 102 can be prevented, the heat roller 102 will not be damaged and therefore stable printing quality is assured. Moreover, even if a sheet of printing paper is wound around the heat roller and pushes up the sensor arm 105, since the protrusion 125 of the sensor arm 105 contacts with the upper portion of the wall of the hole 126 of the restricting part 127, the attaching position of the sensor arm 105 will not be off excessively.

Figure 11:
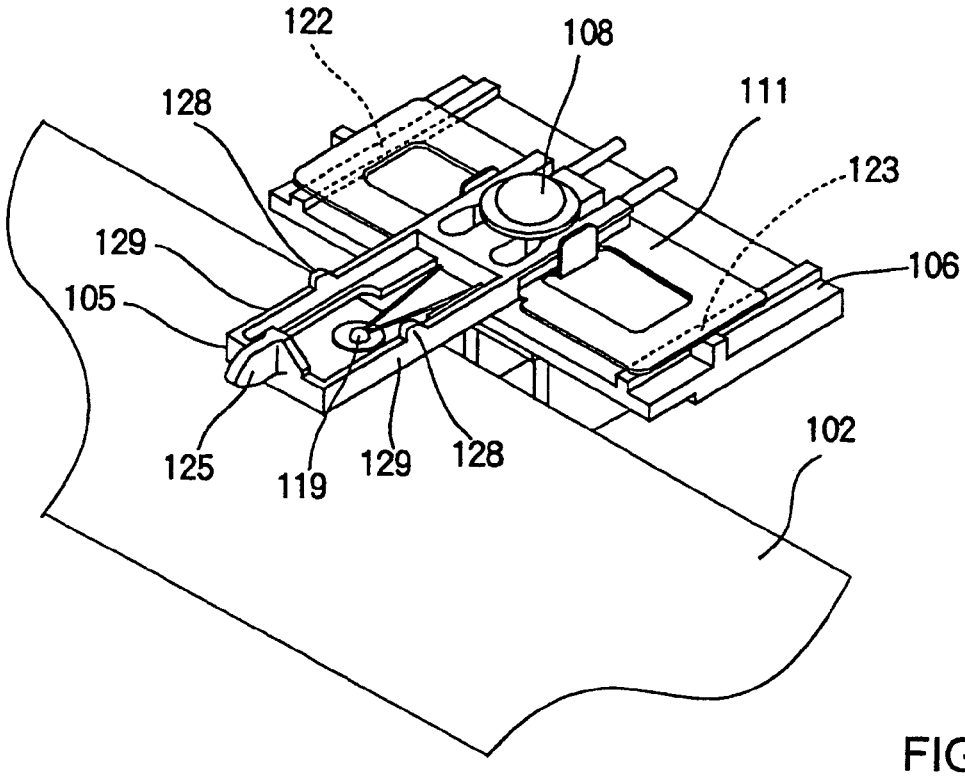
FIG. 11 is a perspective view of the sensor arm of the fifth embodiment of this invention.
Figure 12:
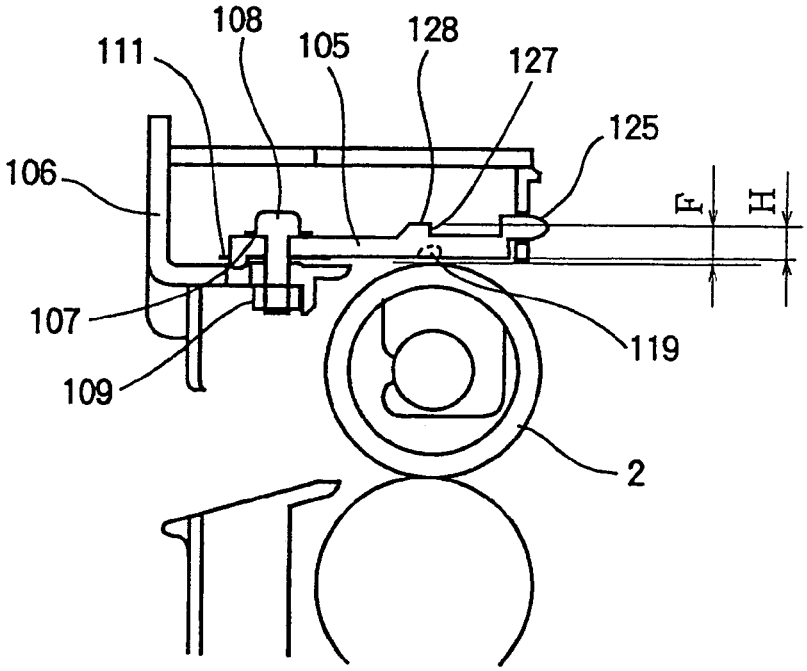
FIG. 12 is a partial cross-sectional view of the fixing device of the fifth embodiment.
Figure 13:
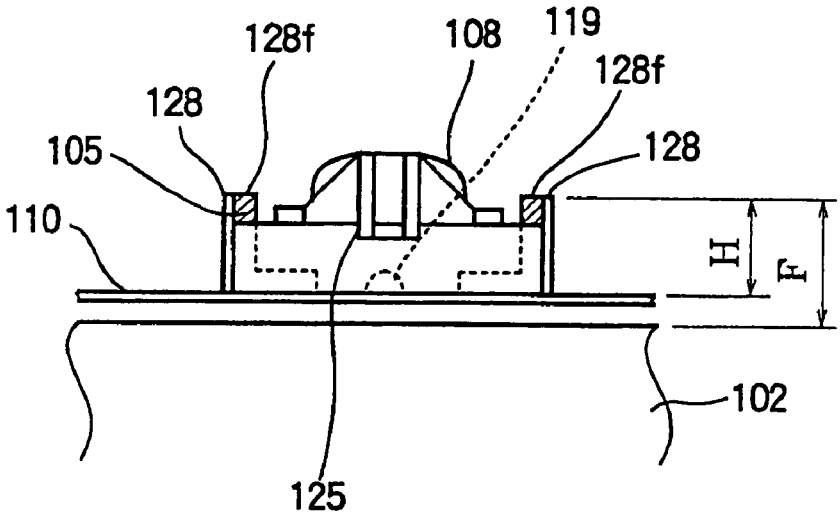
FIG. 13 is a front view of the sensor arm of the fixing device of the fifth embodiment, when it is viewed from the protrusion side provided at the end of the sensor arm.

FIG. 11 shows the sensor arm of the fixing device of the fifth embodiment of this invention, and FIG. 12 is a cross-sectional view of the embodiment. As shown in those figures, this embodiment is different from the fourth embodiment because a second protrusion 128 is respectively provided on two edges 129 of the sensor arm 105. The second protrusion 128 has a surface **128*f* facing the protrusion 125. The protrusion 128 is formed such that the surface 128*f* is included in a plane defined by the center axes of the heat roller 102 and the pressure roller 104. FIG. 13 illustrates the sensor arm 105 viewed from the protrusion 125 side, which is formed at the end of the sensor arm. As shown in this figure, in this embodiment, the height of the upper edge of the surface 128*f* measured from the lower surface of the temperature detector 119** is made constant H.

Figure 14:
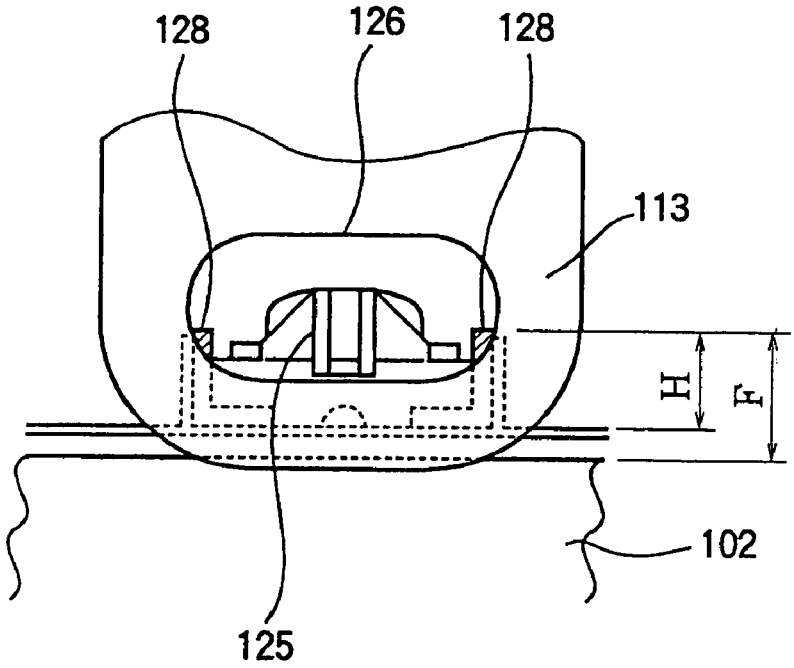
FIG. 14 is an example of a projected image of the heat roller and the protrusion of the sensor arm of the fixing device of the fifth embodiment, which is taken by a camera.
Figure 15:
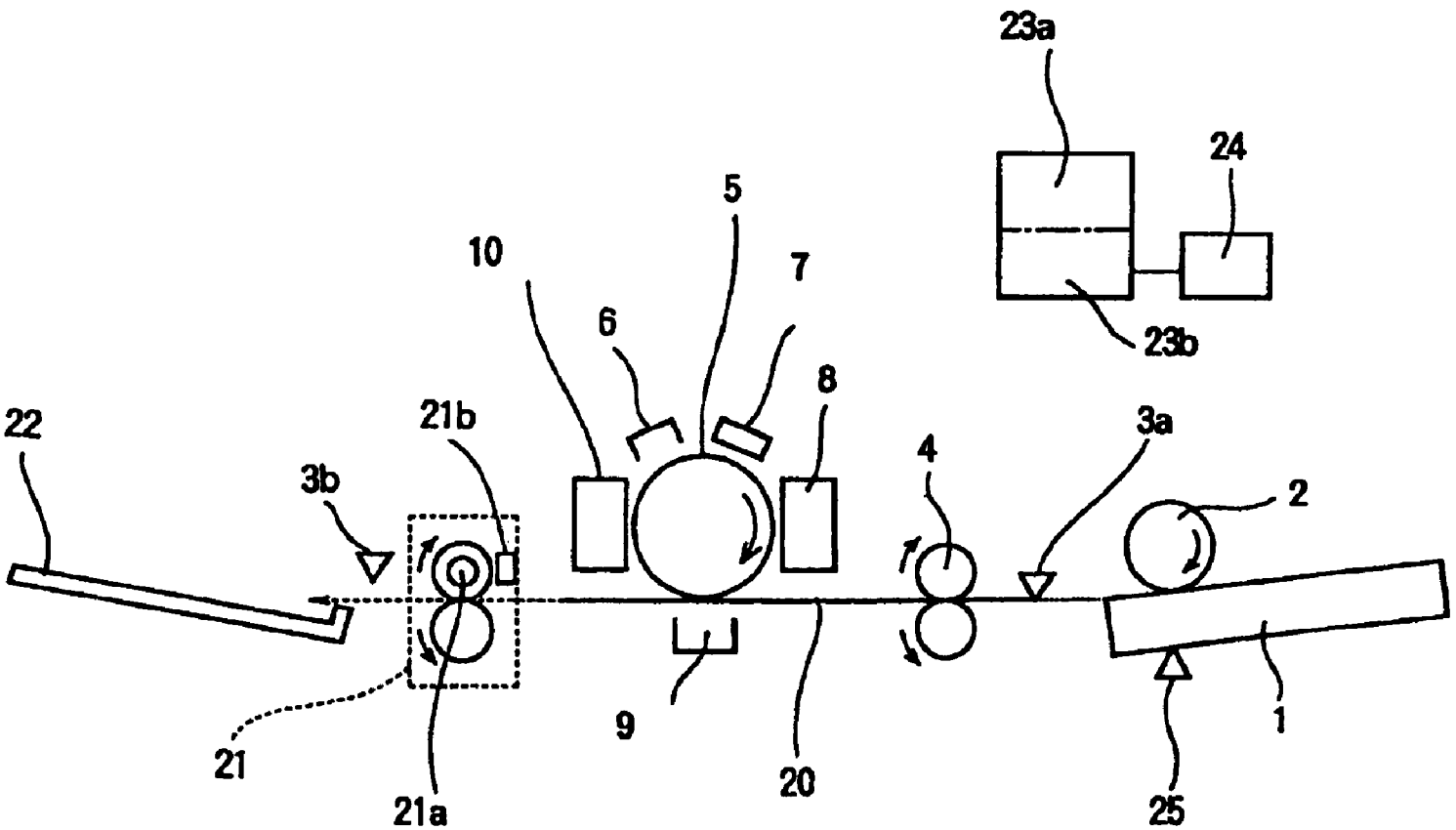
FIG. 15 PRIOR ART
FIG. 15 illustrates the constitution of the electronic photo printer having a conventional fixing device.
Figure 16:
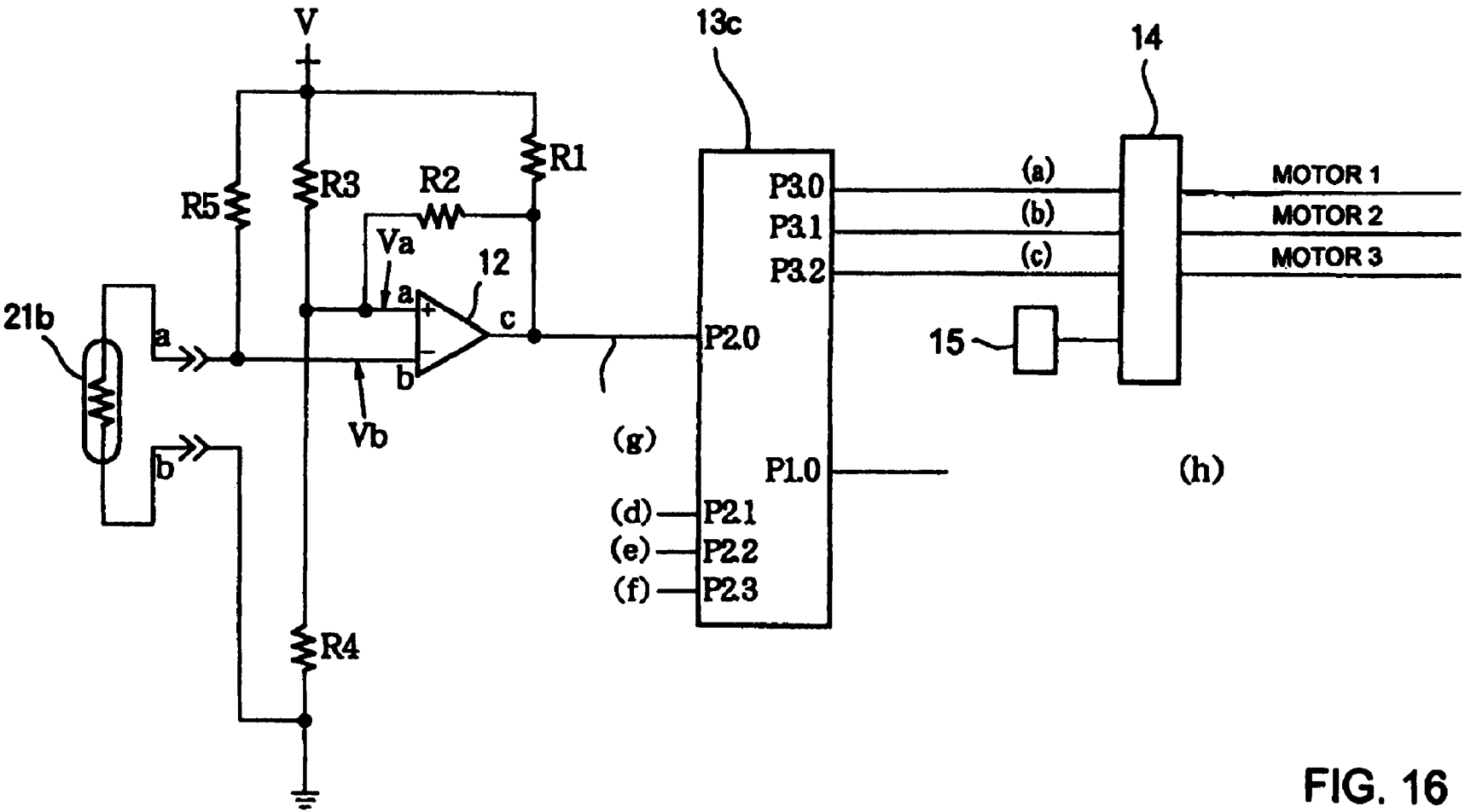
FIG. 16 PRIOR ART
FIG. 16 is a circuit diagram of the controlling unit which controls the mechanism of the electronic photo printer of FIG. 15.
Figure 17:
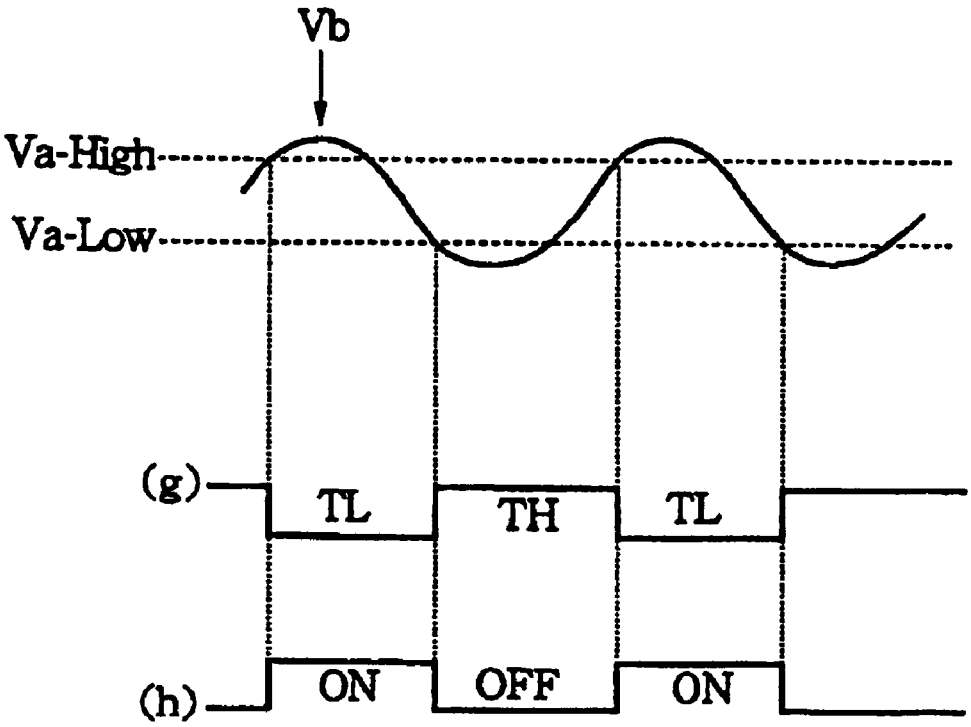
FIG. 17 PRIOR ART
FIG. 17 is a time chart in the temperature control of the heater of the fixing device of the electronic photo printer of FIG. 15.
Figure 18:
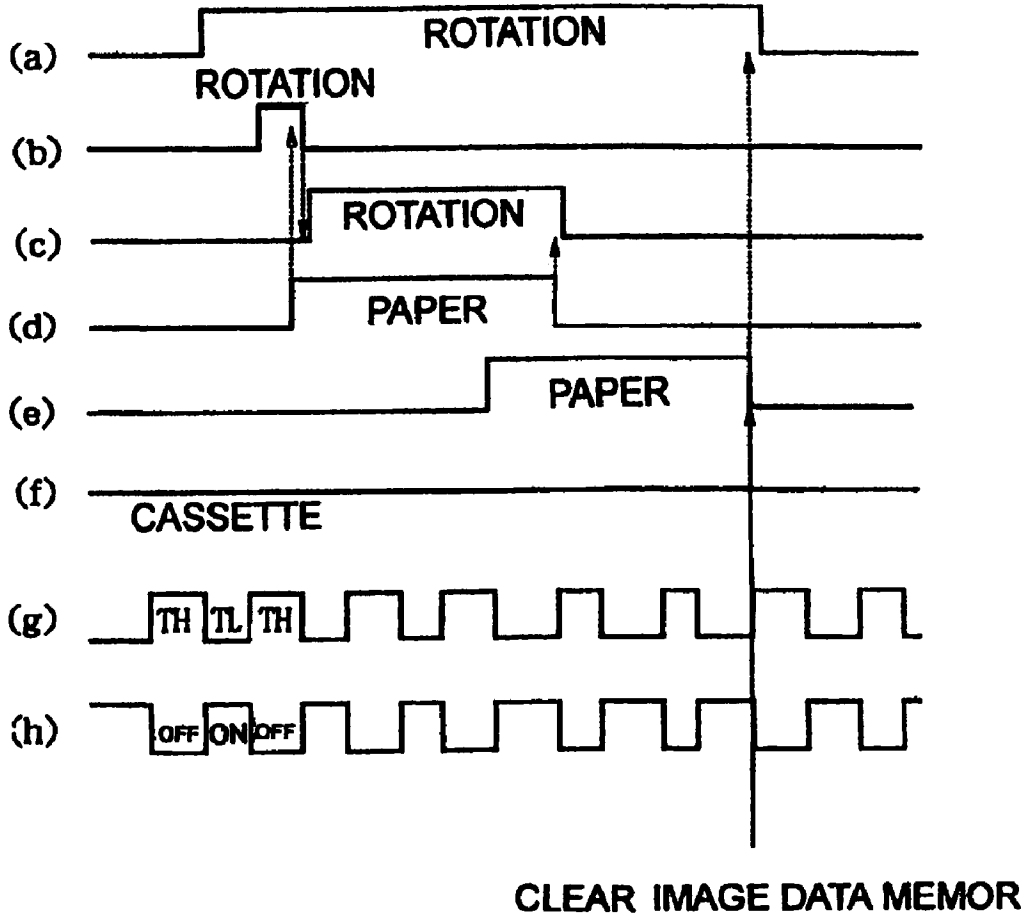
FIG. 18 PRIOR ART
FIG. 18 is a time chart in the method of controlling the operation of the electronic photo printer of FIG. 15.

Similarly to the precedent embodiments, the position of the sensor arm 105 with respect to the heat roller 102 can be adjusted by rotating the screw 108 through the opening 116 of the frame 106. In this embodiment, the distance between the surface of the heat roller 102 and the protrusion 128 can be adjusted using a camera. More specifically, the image of the upper part of the heat roller 102 and the surface **128*f* of the protrusion 128 is first taken by a camera, and projected on a monitor. FIG. 14 shows an example of the image projected on the monitor. Based on this image, the distance F between the upper edge of the heat roller and the upper edge of the surface 128*f* of the protrusion 128 is measured. In this case, the distance between the surface of the heat roller 102 and the bottom surface of the temperature detector 119 can be obtained as a value calculated by subtracting H from F. Once the calculated value agrees with the specified value after rotating the screw 108**, the adjustment of the position is completed.

As described above, according to the fifth embodiment, since the protrusion 128 for measuring the height of the sensor arm 105 is provided to the sensor arm 105, the clearance between the temperature detector 119 of the sensor arm 105 and the heat controlling unit 102 can be measured even if the clearance cannot be observed from the front side. Therefore, the measured value will not vary with the people who conduct the measurement, and therefore the adjustment of the position can be precisely done.

The invention claimed is:

1. A fixing unit for an image forming apparatus, comprising:

a heating element;

a temperature sensor to detect a temperature of said heating element;

an arm to hold said temperature sensor;

a frame to support the heating element;

an elastic member to support the arm; and a positioning member for adjusting a position of said arm with respect to said heating element such that the temperature sensor is away from the heating element with a space therebetween, said positioning member including a connecting member for connecting the arm and the elastic member to adjust the position of the arm with respect to the heating element in a state that the arm and the elastic member are attached to the frame, said connecting member being arranged to be adjustable for a position thereof with respect to the frame so that a deformation amount of the elastic member changes according to the position of the connecting member, said arm being arranged to be movable with respect to the heating element according to the deformation amount of the elastic member.

2. The fixing unit according to claim 1, wherein said position of said arm is adjusted by said positioning member such that said temperature sensor does not contact said heating element.

3. The fixing unit according to claim 1, wherein said frame supports both edge portions of said elastic member.

4. The fixing unit according to claim 1, wherein said elastic member has an opening between a portion thereof supported on said frame and a portion thereof supporting said arm.

5. The fixing unit according to claim 1, wherein said connecting member has a screw penetrating through a center portion of said elastic member, a base portion of said arm, and said frame, and a nut fitted to said screw.

6. The fixing unit according to claim 1, further comprising a spacer having a specified thickness, wherein said connecting member connects a center portion of said elastic member and a base portion of said arm with said frame via said spacer against an elastic force of said elastic member when the position of said arm is adjusted.

7. The fixing unit according to claim 6, wherein said spacer is arranged to be movable between a first position and a second position, and is disposed at said first position when said position of said arm is adjusted, and said positioning member is moved toward said heating element for a specified distance corresponding to the specified thickness of said spacer.

8. The fixing unit according to claim 7, wherein said spacer is disposed at said second position, and said positioning member moves said arm by a specified distance away from said heating element.

9. An image forming apparatus having the fixing unit according to claim 1 to fix a developing agent onto a medium by heating said developing agent.

10. The fixing unit according to claim 1, wherein said elastic member is formed of an elongated plate extending in a first direction parallel to a longitudinal direction of the heating element, said arm extending in a second direction perpendicular to the first direction.

11. The fixing unit according to claim 1, wherein said frame is arranged away from the arm with the elastic member therebetween so that the frame is stationary with respect to the heating element when the positioning member adjusts the position of the arm with respect to the heating element.

12. The fixing unit according to claim 1, wherein said frame is formed of an elongated plate extending in a first direction parallel to a longitudinal direction of the heating element, said arm extending in a second direction perpendicular to the first direction.

13. A fixing unit for an image forming apparatus, comprising:

a heating element;

a temperature sensor to detect a temperature of said heating element;

an arm to hold said temperature sensor;

a frame to support the heating element;

an elastic member to support the arm;

a spacer having a specified thickness; and a positioning member for adjusting a position of said arm with respect to said heating element such that the temperature sensor is away from the heating element with a space therebetween, said positioning member including a connecting member for connecting the arm and the elastic member to adjust the position of the arm with respect to the heating element in a state that the arm and the elastic member are attached to the frame, wherein said elastic member has a flat shape, said elastic member is supported by said frame at two positions which are equally distant from a portion of said elastic member to support said arm, and said connecting member connects a center portion of said elastic member and a base portion of said arm with said frame via said spacer against an elastic force of said elastic member when the position of said arm is adjusted.

14. A fixing unit for an image forming apparatus, comprising:

a heating element;

a temperature sensor to detect a temperature of said heating element;

an arm to hold said temperature sensor;

a frame to support the heating element;

an elastic member to support the arm;

a spacer having a specified thickness; and a positioning member for adjusting a position of said arm with respect to said heating element such that the temperature sensor is away from the heating element with a space therebetween, said positioning member including a connecting member for connecting the arm and the elastic member to adjust the position of the arm with respect to the heating element in a state that the arm and the elastic member are attached to the frame, wherein said connecting member has a screw penetrating through a center portion of said elastic member, a base portion of said arm, and said frame, and a nut fitted to said screw, and said elastic member has a restricting member to restrict movement of said arm in a direction perpendicular to longitudinal directions of said screw and said arm.

15. The fixing unit according to claim 14, wherein said arm has at its end a protrusion extending in the longitudinal direction of said arm, and said frame has a restricting member to restrict movement of said arm in the longitudinal direction of said screw.

16. The fixing unit according to claim 15, wherein said arm has a protrusion having a surface that extends in the longitudinal direction of said screw near said temperature sensor, an upper edge of said surface is specified distance away from said temperature sensor, and said upper edge is arranged so as to be accessible for measurement through a hole of said restricting member.

* * * * *